United States Patent [19]

Moscovitch

[11] 4,167,948

[45] Sep. 18, 1979

[54] CIGARETTE MAKING MACHINE

[76] Inventor: Herman Moscovitch, 2359 de Maisonneuve Blvd. East, Montreal, Quebec, Canada

[21] Appl. No.: 882,774

[22] Filed: Mar. 2, 1978

[51] Int. Cl.[2] ..... A24C 5/42

[52] U.S. Cl. ..... 131/70

[58] Field of Search ..... 131/70, 71, 72, 75, 131/73, 76, 74, 77, 78, 79, 80, 81 R, 81 A, 82, 82 R, 83 P, 85, 86

[56] References Cited

U.S. PATENT DOCUMENTS

| | | | |
|---|---|---|---|
| 3,124,141 | 3/1964 | Seitter | 131/70 |
| 3,127,900 | 4/1964 | Kastner | 131/70 |
| 3,202,156 | 8/1965 | Kappler et al. | 131/70 |
| 3,746,011 | 7/1973 | Kappler et al. | 131/70 |
| 3,886,952 | 6/1975 | Kastner | 131/70 |

*Primary Examiner*—Robert W. Michell
*Assistant Examiner*—J. Millin

[57] ABSTRACT

A domestic cigarette making machine is disclosed. The machine has a lever of bell-crank shape pivotally secured to a tobacco compacting member by a single link in a manner not before considered possible and which results in an economically produced machine.

5 Claims, 6 Drawing Figures

CIGARETTE MAKING MACHINE

The present invention relates to a machine to be used by people to make their own cigarettes using tobacco and preformed hollow cigarette paper tubes.

Many individuals, for purposes principally of economy, and taste, wish to make their own cigarettes and by possessing a small hand-operated cigarette machine, one can by purchasing tobacco and a supply of hollow cigarette paper tubes which are readily available on the market make a supply of cigarettes at a cost less than the cost of an equivalent number of tailor-made cigarettes.

The present machine injects a compacted elongated cylindrical wad of tobacco into a hollow cigarette paper tube which is held on a nipple provided on the machine, and while there are a number of machines of this general type presently available on the market, all known machines of this type have a substantial number of interfitting and moving parts and are fairly costly in manufacture and sale and require fairly constant maintenance.

The present invention overcomes the disadvantages possessed by known machines by providing a machine which is simple and economical in construction and which has a minimum of moving parts and which produces cigarettes of high and constant quality with minimum upkeep.

DISCUSSION OF PRIOR ART

Known machines usually have a single operating lever which acts both to compact a wad of tobacco against a spoon member with further rotation of the single handle causing the spoon and wad of tobacco to be injected into a cigarette paper tube held on a nipple of the machine. Although a single lever may result in simpler operation, it does require a great number of interworking and interfitting parts and malfunction of any of the component parts can result in the machine being inoperative. Additionally, such single lever machines are reasonably expensive to manufacture and production costs must, of course, be passed on to the user at the time of sale.

Also, machines presently available on the market cause compaction of the tobacco by movement of a tobacco compacting member which is moved by a toggle arm which works through a pair of parallel links and with known constructions this parallel linkage is necessary in order to maintain the tobacco compacting member in precise alignment in the tobacco compacting chamber so that the wad of tobacco is correctly and exactly positioned in injection alignment with the positioned tube.

GENERAL DISCUSSION OF INVENTION

The present invention provides a machine having a two lever operation, the first lever causing compaction of a wad of tobacco into an elongate cylindrical form, with movement of the second lever causing injection of the wad into a cigarette paper tube. The actions of the two levers are extremely simple and as indicated a minimum of working parts is required so that the machine is highly durable and requires a minimum of upkeep and maintenance.

It has now been found that it is possible to move the tobacco compacting member by utilizing only one single link in a manner which herebefore was not considered possible if a satisfactory cigarette was to be obtained.

One embodiment of the invention contemplates molding the combined tobacco compacting member from a NYLON (Registered trade mark for a synthetic polyamide composition) material which smoothly moves in a compartment which may be formed of acryonitrite-butadiene-styrene (ABS) or similar plastics material. Alternatively, precise alignment may be accomplished according to a further embodiment by providing spaced and parallel grooves in the compacting member and guide projections on the casing which extend into the grooves whereby the compacting member is maintained in precise alignment during both its movement into and out of tobacco compacting position.

It will be appreciated, however, that the guide projections could be provided on the compacting member and the spaced and parallel grooves in the casing without departing from the scope of the concept.

Of course, when the grooves and guides are employed, any material such as metal can be used.

In the present arrangement, the main operating handle which is of bell-crank configuration is pivotally secured to the casing, and one end of the single link member is pivotally secured to the inner end of the main operating handle, with the other end of the link being pivotally secured to the compacting member. When the three pivots are in alignment maximum tobacco compaction is achieved, and it has now been found that injection of a wad of compacted tobacco is facilitated and a superior cigarette product obtained if the compaction member is withdrawn slightly from its maximum compaction position. The present invention provides this advantage by having the main operating handle move past the position of alignment of the three pivots and so after maximum compaction there is some release of the compaction pressure which facilitates injection of the wad of tobacco.

SPECIFIC DESCRIPTION OF INVENTION

The main object of the invention is to provide a machine having the above advantages for injecting a compacted elongated cylindrical wad of tobacco into a hollow cigarette paper tube, comprising a casing and an operating handle pivotally (A) carried thereby, the operating handle being of bell-crank shape and having one end of a single link pivotally (B) secured to its inner arm, the other end of the link being pivotally (C) secured to a tobacco compacting member, and an elongated injection spoon slidably movable within the casing from a tobacco receiving position to an extending position to inject a cylindrical wad of tobacco into a tube positioned on an aligned nipple exteriorly of the casing, and a spoon handle extending exteriorly of the casing enabling manual sliding movement of the spoon, and a pivotally mounted tube retaining lever to hold the tube in position on the nipple during insertion of the tobacco wad, a spring holding the tube retaining lever in contact with the nipple when the operating handle is in tobacco compacting position, and a stud on the tube retaining lever, the said single link contacting the said stud and pivoting the tube retaining lever out of contact with the said nipple when the operating handle is in tobacco receiving position.

BRIEF DESCRIPTION OF ACCOMPANYING DRAWINGS

DETAILED DESCRIPTION OF PREFERRED EMBODIMENT

Figure 1:
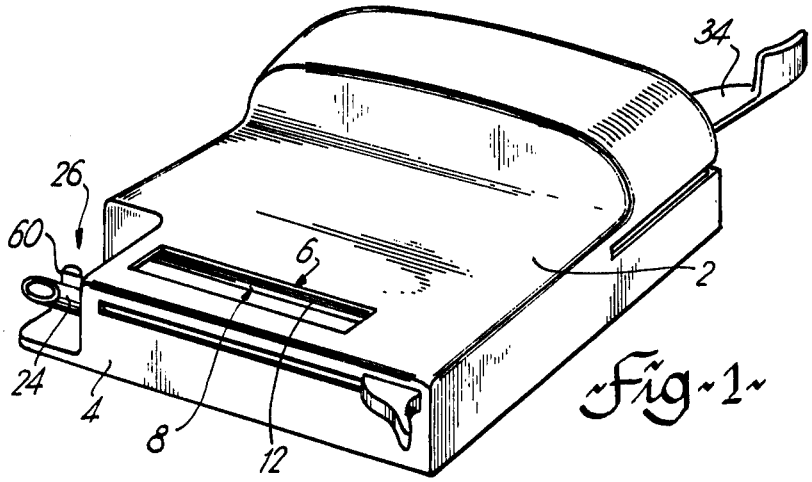
FIG. 1 illustrates in perspective view the outward appearance of a cigarette making machine according to the present inventive concept.

Reference will now be specifically had to the accompanying drawings wherein like reference numerals refer to like parts.

Figure 2:
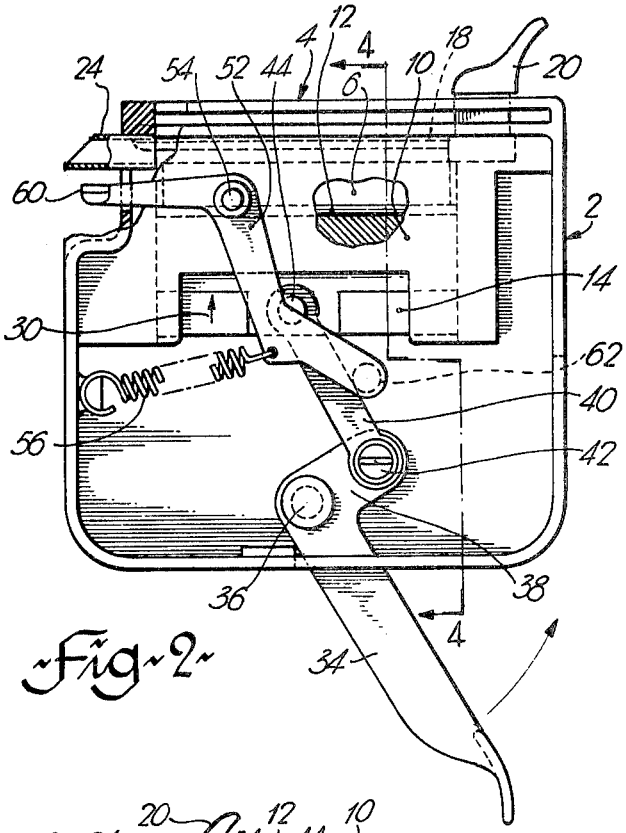
FIG. 2 illustrates the machine illustrated in FIG. 1, in bottom plan view with the main operating lever in position whereby a supply of tobacco may be positioned within the machine for subsequent compaction and injection into a cigarette tube.
Figure 3:
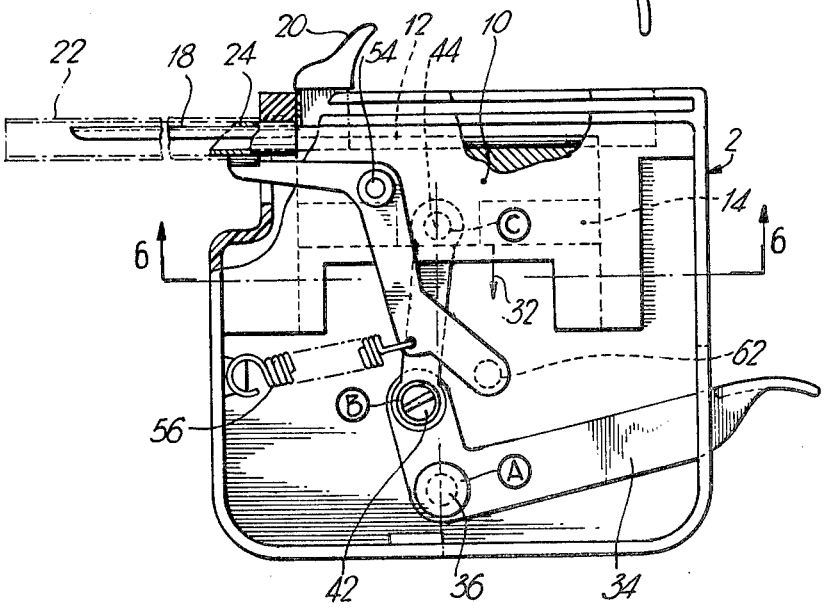
FIG. 3 illustrates a bottom view of the machine showing the main lever being pivoted to a lateral position whereby tobacco placed in the machine is compacted into rod-shaped cylindrical configuration and ready for injection into a cigarette paper tube.

The machine consists of a body or casing unit 2 of stylized configuration which has on its upper surface adjacent the front edge 4 of the machine an elongate aperture 6 for receiving a supply of tobacco as will be described in more detail below. The opening 6 opens into a chmaber 8 defined by a bottom 10 (see particularly FIG. 4), the leading concave edge 12 of a tobacco compacting member 14 and the concave surface portion 16 of a spoon member 18. (See also FIG. 5). The spoon member 18 is secured to a spoon handle 20 and the spoon handle 20 and spoon member 18 are movable from their positions as shown in FIGS. 1 and 2, to a tobacco injecting position as shown in FIG. 3 to inject a wad of tobacco into a cigarette tube (which is shown at 22 in broken lines in FIG. 3) and which is positioned on nipple 24 which is rigidly secured to the casing 2. The nipple 24 may be positioned within a corner cut-out portion 26 of the casing as shown in FIG. 1.

Figure 4:
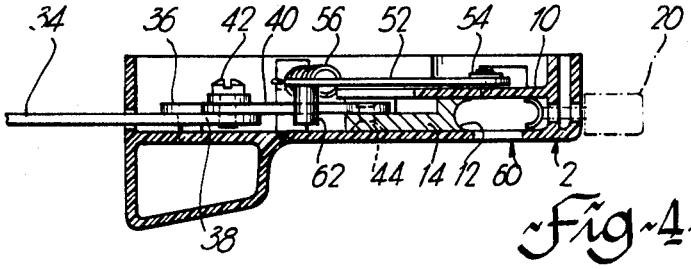
FIG. 4 is a sectional view taken along line 4—4 of FIG. 2.

The bottom 10 providing chamber 8 is secured to the casing 2 and as shown in FIGS. 2, 3 and 4, a tobacco compacting member 14 having a concave leading edge 12 is positioned for reciprocal movement in accordance with the arrows 30 and 32 in FIGS. 2 and 3, respectively, with this reciprocal movement being dependent upon the actual positioning and movement of the main operating lever 24.

The operating lever 34 is pivotally carried by the casing 2 by means of screw or stud 36. The lever 34 is of bell-crank lever configuration and the inner angled arm 38 of the lever 34 is pivotally secured to a link member 40 by means of pivot 42. The other end of the link 40 is pivotally secured to the tobacco compacting member 14 by means of pivot 44, and it will be appreciated that movement of lever 34 from the position shown in FIG. 2 to the lateral position shown in FIG. 3 will cause movement of the tobacco compacting member from the "open" position shown in FIG. 2 to the "closed" position shown in FIG. 3 whereby tobacco positioned in the chamber 8 through opening 4 will be compacted against the concave spoon 16 to form a cylindrical rod of tobacco (not shown) ready for injection into a tube 22 positioned on nipple 24.

It will be noted from FIG. 3 that the lateral movement of the lever 34 causes pivot 42 to move past dead centre between pivots 36 and 44. This is an important feature. During movement of the lever 34 from the position in FIG. 2 to the position in FIG. 3 the tobacco compacting member will compact the tobacco to a maximum degree when all three pivots 36, 42 and 44 (pivots A, B and C) are in direct alignment, but it has been found that by withdrawing the tobacco compacting member a small amount after maximum compaction of the tobacco a more superior operation of the machine results, and enables the user to inject the wad of tobacco into a cigarette tube with less effort and with superior results. Thus, in operation, when the lever is moved to its tobacco compacting direction the tobacco compacting member first squeezes the supply of tobacco and when the pivots 36, 42 and 44 are in alignment, exerts a maximum compression on the tobacco in the chamber, and then continued rotation results in some relaxation of the compaction to facilitate insertion of the wad of tobacco into the tube by movement of the handle 20 and spoon 16 from the position shown in FIG. 2 to the position shown in broken lines in FIG. 3.

Some cigarette making machines employ a tobacco compacting member which compacts a wad of tobacco into generally cylindrocal rod configuration but all of these known machines utilize parallel links and an interconnecting toggle arm to ensure that the tobacco compacting member is maintained in precise alignment during its movement into the tobacco compacting position but it has now been found that the more complicated parallel link and toggle arrangement is not absolutely necessary and that a single link pivotally moujted between the operating lever and the tobacco compacting member results in a highly satisfactory product with a minimum of moving parts. This arrangement removes the necessity of parallel linkages, toggle arms and camming surfaces of prior art constructions.

Figure 6:
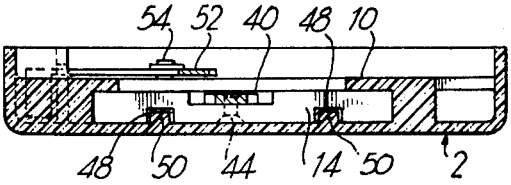
FIG. 6 is a sectional view taken along line 6—6 of FIG. 3.

The inventive concept also contemplates in a further embodiment providing parallel slots 48 (see FIG. 6) in the cutter 14 and by providing guides in the form of downwardly projecting studs 50 on the lower surface of the casing 2, and it will be appreciated that the slots move along the guides during movement of the lever to maintain the tobacco compacting member 14 in precise alignment with the concave spoon member 16 and between which the wad of tobacco is compacted.

In operation the user pivots the operating lever 34 to the position shown in FIG. 2 which withdraws the tobacco compacting member 14 to the "open" position shown in this view. The handle 20 and spoon 16 will also be moved to the position shown in FIGS. 1 and 3 so that the chamber is ready for the reception of a supply of tobacco. After the tobacco is positioned in the chamber, the lever 34 is then pivoted to the position shown in FIG. 2, whereby the tobacco (not shown) is compacted in cylindrical rod form between the concave leading edge 12 of the compacting member 14 and the concave spoon 16. Handle 20 is then moved to the position shown in FIG. 3 whereby the compacted wad of tobacco is injected into a tube 22 previously positioned on the nipple 24.

To retain the tube 22 on the nipple during injection a tube retaining lever 52 is provided. The lever 52 is also of bell-crank configuration and is secured for pivotal movement to the bottom surface of the bottom 10 by means of pivot 54. A spring 56 extends between the side 58 of the casing and the lever 52 and the action of the spring is to normally hold the tip 60 on the outermost end of the lever 52 against the nipple 24. The innermost end of the lever 52 is provided with a stud 62 which is positioned to be contacted by the link 40. When the handle 34 is in the position shown in FIG. 2, the stud 62 is contacted by the link 40 and the lever 52 is pivoted against the action of spring 56 to the position shown in FIG. 2 wherein the tip 60 is removed from the nipple 24. It is in this position that a tube 22 will be positioned on the nipple 24. When the handle 34 is moved to the tobacco compacting position as shown in FIG. 3, however, spring 56 is then able to move the lever 52 to the tube retaining position shown in FIG. 3.

It has been found that coating the leading edge 12 of the tobacco compacting member with TEFLON may be advantageous if the tobacco compacting member is made of metal. However, such a coating is not required if the tobacco compacting member is made of NYLON. TEFLON is a registered trade mark of E. I. DuPont de Nemours designating polytetrafluoroethylene.

Figure 5:
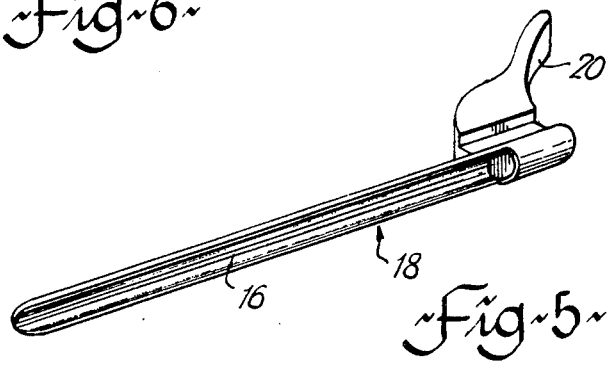
FIG. 5 is a perspective view of a new injection spoon and handle arrangement.

A novel spoon 16 and handle 20 arrangement used with the present machine is shown in FIG. 5. The injection spoon 16 which is of metal and of concave configuration throughout its injection length is provided with a hollow integral sleeve 68 which receives a plastic stud or insert 70 which is molded integrally with the handle 20 and spaced therefrom by arm 72. The arm 72 rids in a double wall arrangement in the casing (see FIG. 4) so that the movement of the spoon is precise and correct.

I claim:

1. A machine for injecting a compacted elongate cylindrical wad of tobacco into a hollow cigarette paper tube, comprising a casing and an operating handle pivotally (A) carried thereby, the operating handle being of bell-crank shape and having one end of a single link pivotally (B) secured to its inner arm, the other end of the link being pivotally (C) secured to a tobacco compacting member, and an elongate injection spoon slidably movable within the casing from a tobacco receiving position to an extending position to inject a cylindrical wad of tobacco into a tube positioned on an aligned nipple exteriorly of the casing and a spoon handle extending exteriorly of the casing enabling manual sliding movement of the spoon, and a pivotally mounted tube retaining lever to hold the tube in position on the nipple during insertion of the tobacco wad, a spring holding the tube retaining lever in contact with the nipple when the operating handle is in tobacco compacting position, and a stud on the tube retaining lever, the said single link contacting the said stud and pivoting the tube retaining lever out of contact with the said nipple when the operating handle is in tobacco receiving position.

2. A machine according to claim 1 including spaced and parallel grooves in the tobacco compacting member extending in the direction of movement of the said member, and guide projections on the casing and positioned in the grooves thereby ensuring precisely alignment movement of the tobacco compacting member.

3. Machine according to claim 1, the operating handle during movement to a tobacco compacting position imparting maximum tobacco compaction when pivots A, B and C are in alignment with further movement of the operating handle slightly withdrawing the compacting member to less compaction force and facilitate injection.

4. Machine according to claim 1, wherein the tobacco compacting member is made of Nylon.

5. Machine according to claim 1, wherein the spoon is of metal and is of concave configuration during its injection length, the spoon having a cylindrical sleeve at one end receiving and secured to cylindrical plug molded integrally with the spoon handle.

* * * * *